US010468786B2

(12) United States Patent
De Cloet et al.

(10) Patent No.: US 10,468,786 B2
(45) Date of Patent: Nov. 5, 2019

(54) ELECTRICAL CONNECTION DEVICE, A METHOD OF MANUFACTURING AN ELECTRICAL CABLE AND A MANUFACTURED ELECTRICAL COAXIAL CABLE

(71) Applicants: TE Connectivity Germany GmbH, Bensheim (DE); TE Connectivity Corporation, Berwyn, PA (US)

(72) Inventors: Olivier De Cloet, Lorsch (DE); Christian Schrettlinger, Bensheim-Auerbach (DE); Wolfgang Mueller, Darmstadt (DE); Keith Richard Foltz, Duncannon, PA (US)

(73) Assignees: TE Connectivity Germany GmbH, Bensheim (DE); TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 15/457,487

(22) Filed: Mar. 13, 2017

(65) Prior Publication Data

US 2017/0271784 A1 Sep. 21, 2017

(30) Foreign Application Priority Data

Mar. 17, 2016 (EP) ..... 16160927

(51) Int. Cl.
*H01R 9/05* (2006.01)
*H01R 4/20* (2006.01)
(Continued)

(52) U.S. Cl.
CPC ..... *H01R 4/20* (2013.01); *H01R 9/0503* (2013.01); *H01R 9/0518* (2013.01); *H01R 24/38* (2013.01);
(Continued)

(58) Field of Classification Search
CPC ..... H01R 24/38; H01R 9/05; H01R 12/596; H01R 9/032; H01R 9/0518; H01R 13/59; H01R 13/6592
(Continued)

(56) References Cited

U.S. PATENT DOCUMENTS 6,808,417 B2 * 10/2004 Yoshida ..... H01R 9/0518 439/585
2008/0318476 A1 * 12/2008 Weber ..... H01R 9/032 439/607.41
(Continued)

FOREIGN PATENT DOCUMENTS

JP 11176527 7/1999
JP 2003317882 11/2003
(Continued)

OTHER PUBLICATIONS

European Search Report, dated Jul. 26, 2016, 9 pages.
(Continued)

*Primary Examiner* — Hae Moon Hyeon
*Assistant Examiner* — Justin M Kratt
(74) *Attorney, Agent, or Firm* — Barley Snyder

(57) ABSTRACT

An electrical connection device comprises a cable, a ferrule, and a first electrical contact. The cable has an outer conductor surrounding an inner conductor. The ferrule is mechanically connected to the outer conductor. The first electrical contact is electrically connected to the inner conductor.

20 Claims, 14 Drawing Sheets

(51) Int. Cl.

| | |
|---|---|
| ***H01R 24/38*** | (2011.01) |
| ***H01R 43/04*** | (2006.01) |
| ***H01R 24/40*** | (2011.01) |
| *H01R 12/59* | (2011.01) |
| *H01R 13/6592* | (2011.01) |
| *H01R 13/59* | (2006.01) |
| *H01R 103/00* | (2006.01) |
| *H01R 4/18* | (2006.01) |

(52) U.S. Cl.
CPC ..... *H01R 24/40* (2013.01); *H01R 43/04* (2013.01); *H01R 4/188* (2013.01); *H01R 9/05* (2013.01); *H01R 12/596* (2013.01); *H01R 13/59* (2013.01); *H01R 13/6592* (2013.01); *H01R 2103/00* (2013.01); *H01R 2201/26* (2013.01)

(58) Field of Classification Search
USPC ..... 439/578, 98, 99, 585, 584, 607.41, 439/607.48, 607.5
See application file for complete search history.

(56) References Cited

U.S. PATENT DOCUMENTS

2012/0129391 A1* 5/2012 Van Swearingen .... H01R 4/029 439/578
2015/0311602 A1* 10/2015 Duesterhoeft ..... H01R 4/4818 439/817

FOREIGN PATENT DOCUMENTS

| | | |
|---|---|---|
| JP | 2006302824 | 11/2006 |
| JP | 2006310135 | 11/2006 |
| WO | 2012118134 A1 | 2/2012 |

OTHER PUBLICATIONS

Abstract of JP2006310135, dated Nov. 9, 2006, 1 page.
Abstract of JP2006302824, dated Nov. 2, 2006, 1 page.
Abstract of JP11176527, dated Jul. 2, 1999, 1 page.
Abstract of JP2003317882, dated Nov. 7, 2003, 1 page.

* cited by examiner

ELECTRICAL CONNECTION DEVICE, A METHOD OF MANUFACTURING AN ELECTRICAL CABLE AND A MANUFACTURED ELECTRICAL COAXIAL CABLE

CROSS-REFERENCE TO RELATED APPLICATION

This application claims the benefit of the filing date under 35 U.S.C. § 119(a)-(d) of European Patent Application No. 16160927.6, filed on Mar. 17, 2016.

FIELD OF THE INVENTION

The present invention relates to an electrical connection device of an electrical connector, and more particularly, to an electrical connection device for a cable.

BACKGROUND

Known electrical connectors transfer electrical currents, voltages, signals, and data with a large bandwidth of currents, voltages, frequencies, and data rates. In low, medium, or high voltage or current ranges, and in particular in the automotive industry, such connectors must guarantee the transfer of electrical power, signals, and data in hot, contaminated, humid, or chemically aggressive environments. Due to the large range of applications, a large number of specifically configured connectors are known.

Known electrical connectors throughout the range of applications have housings assembled with an electrical member, such as an electrical cable or a circuit board of an electrical component, for mating with a mating electrical connector. An electrical connector must reliably secure an electrical connection device within the housing for connecting to the electrical member. Furthermore, the electrical connector must reliably transmit electrical signals, and consequently, known electrical connectors have fasteners for detachably fastening to the mating electrical connector. The housings of known electrical connectors are mostly subject to a particular standardization, for example the FAKRA standard, so the most important dimensions of the housings have the same dimensions with different manufacturers. Known electrical connectors having electrical connection devices for cables, however, are too large and expensive to produce for a given maximum current load capacity of the cable.

SUMMARY

An object of the invention, among others, is to provide an electrical connection device for a cable which is small, easy to manufacture, and inexpensive. An electrical connection device according to the invention comprises a cable, a ferrule, and a first electrical contact. The cable has an outer conductor surrounding an inner conductor. The ferrule is mechanically connected to the outer conductor. The first electrical contact is electrically connected to the inner conductor.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
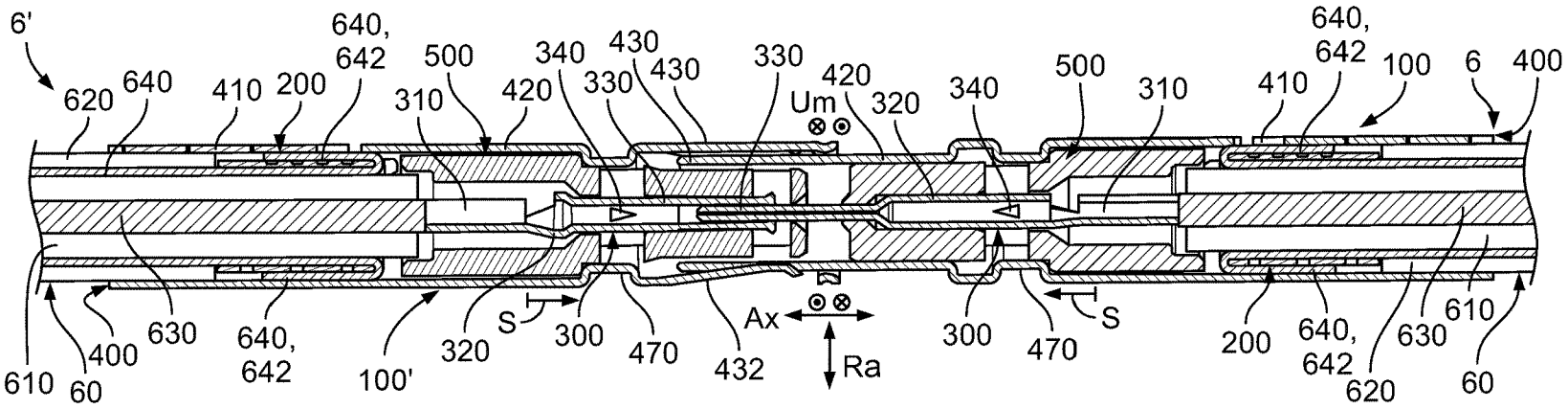
FIG. 1 is a sectional side view of a connection device and a counter-connection device according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

A connection device 100 and a counter-connection device 100' according to the invention are shown in FIG. 1. Each of the connection device 100 and the counter-connection device 100' includes a coaxial cable 60. In embodiments of the invention, the coaxial cable 60 is a copper or aluminum coaxial cable 60. Assembly of the coaxial cable 60 with the connection device 100, 100' will now be explained in greater detail with reference to FIGS. 2-22.

A first step I of the assembly of the coaxial cable 60 with the connection device 100 is shown in FIGS. 2-5. In the first step I, generally, a ferrule 200 is fitted to the coaxial cable 60. The method of assembling the ferrule 200 with the coaxial cable 60 for the connection device 100 described below is identical to a method of assembling the ferrule 200 with the coaxial cable 60 for the counter-connection device 100'.

Figure 2:
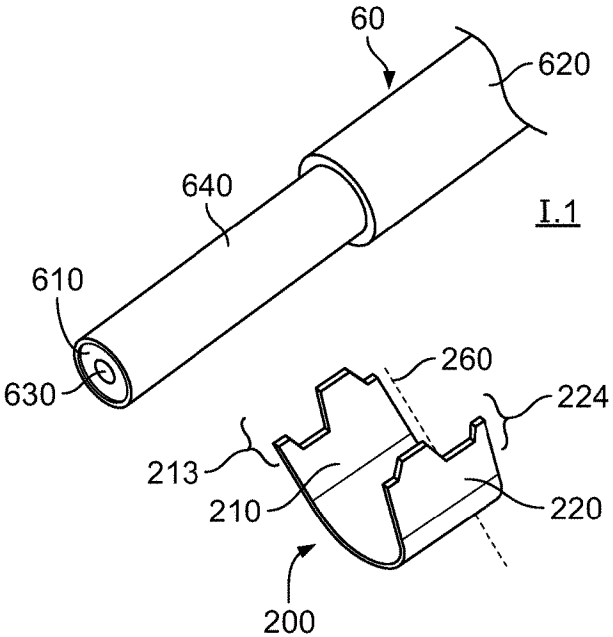
FIG. 2 is a perspective view of a cable and a ferrule of the connection device in a first partial step of a first step of an assembly of the cable with the connection device or the counter-connection device.

The coaxial cable 60, as shown in FIG. 2, has an outer insulation 620 removed at an exposed longitudinal end section of the coaxial cable 60. At the end section of the coaxial cable 60, an outer conductor 640 is exposed in a first partial step I.1. A rear section of the outer conductor 640 is inserted into the ferrule 200, the ferrule 200 located on a carrier strip 260. The ferrule 200 has a U-shaped cross-section and is integrally formed in a single material layer as shown in FIG. 2.

Figure 3:
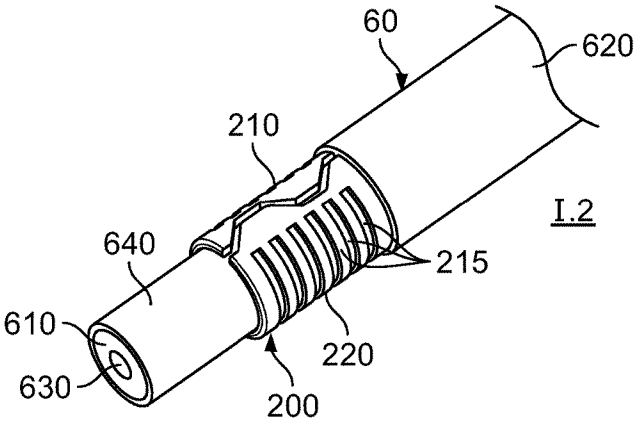
FIG. 3 is a perspective view of the cable and the ferrule of the connection device in a second partial step of the first step of the assembly of the cable with the connection device or the counter-connection device.

Subsequently, in a second partial step I.2 as shown in FIG. 3, the ferrule 200 is fastened, in particular crimped, to the rear section of the outer conductor 640. An entire length of the ferrule 200 in a longitudinal direction of the ferrule 200 is connected to the outer conductor 640 and the ferrule 200 has a substantially constant internal diameter in the longitudinal direction of the ferrule 200. The ferrule 200 can be separated from the carrier strip 260 either prior to or after the crimping shown in FIG. 3. The ferrule 200, as shown in FIG. 2, has a pair of opposing crimping flanks 210, 220. Each crimping flank 210, 220 has a circumferential edge section 213, 224. The two circumferential edge sections 213, 224, as shown in FIGS. 2 and 3, substantially complement one another. The circumferential edge sections 213, 224, in the position of FIG. 3 in which the ferrule 200 is crimped to the outer conductor 640, are substantially form-locking so that a gap between the crimping flanks 210, 220 in an axial direction Ax shown in FIG. 1 is substantially impermeable to light.

During plastic deformation of the ferrule 200 while crimping, a locking projection 240 as shown in FIGS. 6-17 and 20-22 may be formed at the ferrule 200. Furthermore, alternatively or additionally during the plastic deformation of the ferrule 200, at least one other structure can be formed on the outside of/in the ferrule 200, leading to improved electrical contacting between the ferrule 200 and an end section 642 of the outer conductor 640 provided on its outside, as shown in FIG. 4.

Figure 4:
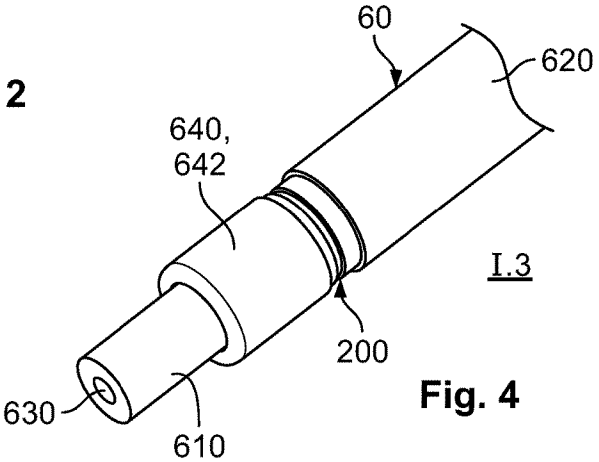
FIG. 4 is a perspective view of the cable and the ferrule of the connection device in a third partial step of the first step of the assembly of the cable with the connection device or the counter-connection device.

In a third partial step I.3 shown in FIG. 4, an exposed section of the outer conductor 640 projecting from the ferrule 200 is bent back around the outside of the ferrule 200 as end section 642 of the outer conductor 640. The end section 642 of the outer conductor 640, as shown in FIG. 1, thus has a circumferential U-shape. In such an embodiment, an electrically non-conductive ferrule 200 may be used. In other embodiments, it is possible to omit the third partial step I.3 forming the bent end section 642 of the outer conductor 640, and in this embodiment, the ferrule 200 is produced from an electrically conductive material and an exposed end of the outer conductor 640 substantially coincides axially Ax with an exposed end of the ferrule 200.

Figure 5:
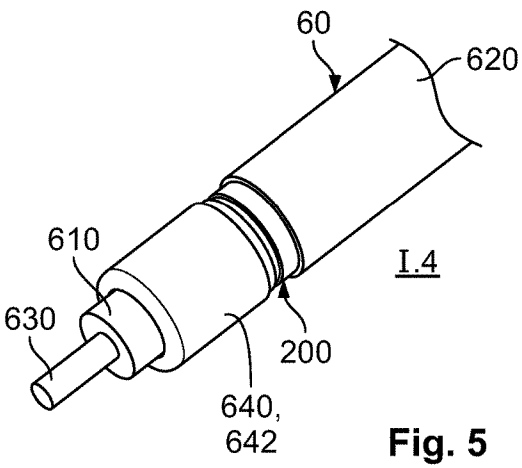
FIG. 5 is a perspective view of the cable and the ferrule of the connection device in a fourth partial step of the first step of the assembly of the cable with the connection device or the counter-connection device.

In a fourth partial step I.4 shown in FIG. 5, an inner conductor 620 and a surrounding inner insulation 610 of the coaxial cable 60 project from the end section 642 of the outer conductor 640. The inner insulation 610 is removed from a longitudinal end section of the inner conductor 630 as shown in FIG. 5, leaving a comparably small rear section of the inner insulation 610 adjacent the end section 642. The end of the first step I results in a pre-assembled cable 60 as shown in FIG. 5.

Figures 6, 7:
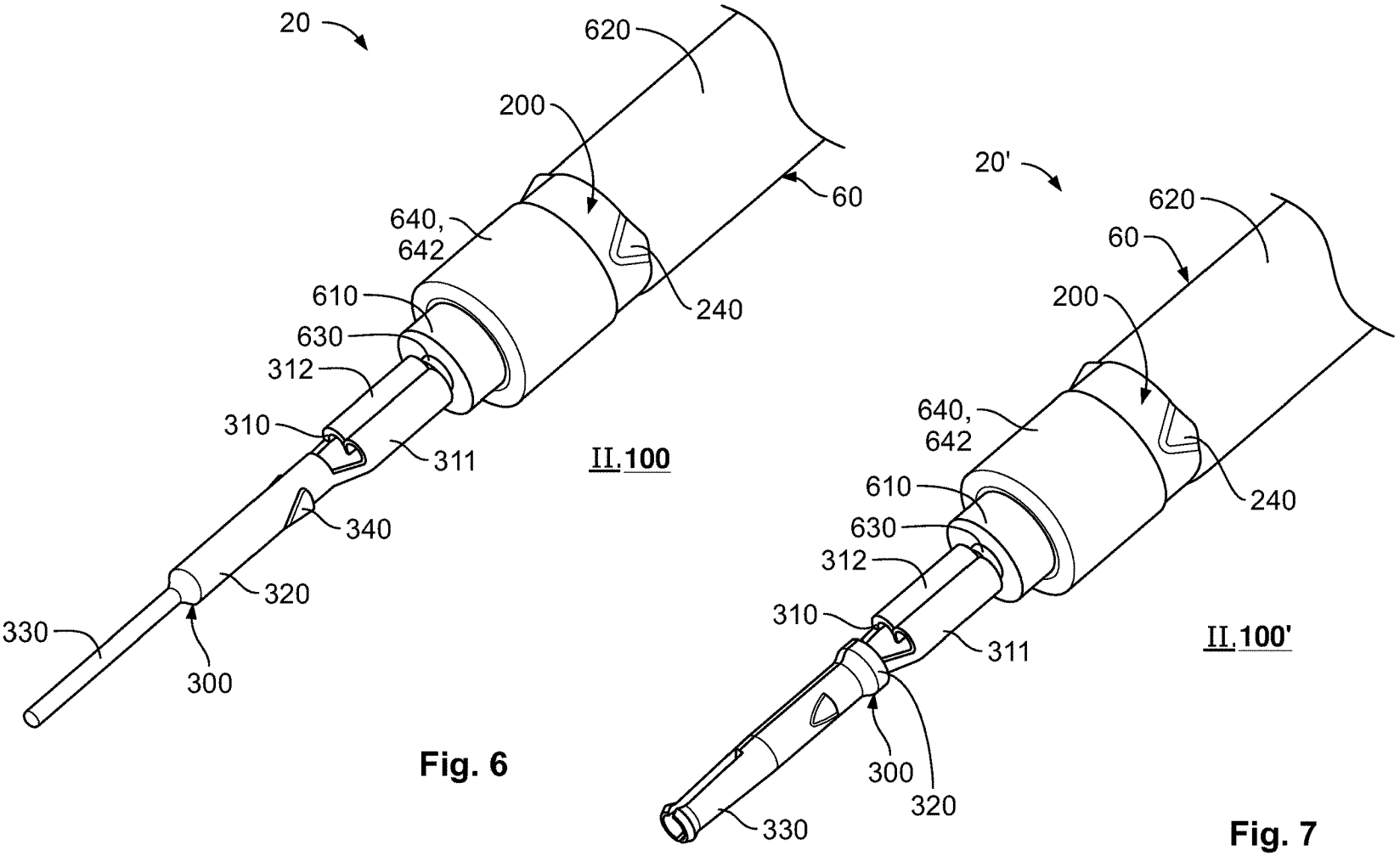
FIG. 6 is a perspective view of the cable, the ferrule, and a first electrical contact of the connection device in a second step of the assembly of the cable with the connection device.
FIG. 7 is a perspective view of the cable, the ferrule, and a first electrical contact of the counter-connection device in a second step of the assembly of the cable with the counter-connection device.

A second step II of the assembly of the coaxial cable 60 with the connection device 100 and the counter-connection device 100' is shown in FIGS. 6 and 7. In the second step II, generally, a first electrical contact 300 is mounted to the connection device 100 and the counter-connection device 100', respectively.

The elongated and integrally formed first electrical contact 300, as shown in FIGS. 6 and 7, has on a rear end a crimping section 310 with two crimping wings 311, 312. The first electrical contact 300 has a contact section 330 on a front end. The contact section 330 may be a pin, as shown in FIG. 6 for the first electrical contact 300 used with the connection device 100, or a jack, as shown in FIG. 7 for the first electrical contact 300 used with the counter-connection device 100'. The first electrical contact 300 also has a transitional section 320 between the crimping section 310 and the contact section 330 and a locking projection 340 disposed in the transitional section 320.

In the second step II, the first electrical contact 300 is first separated from a carrier strip for first electrical contact 300. Subsequently, the crimping section 310 is moved towards an exposed longitudinal end section of the inner conductor 630, the longitudinal end section of the inner conductor 630 positioned in a bottom of the crimping section 310. Subsequently, the crimping section 310 is crimped to the inner conductor 630. In other embodiments, this can also take place in reverse, as the crimping section 310 can be crimped to the inner conductor 630 while the first electrical contact 300 is still located on the carrier strip.

At the end of the second step II, a sub-assembly 20 having the cable 60 with the ferrule 200 and the first electrical contact 300 for the connection device 100 is obtained and a sub-assembly 20' having the cable 60 with the ferrule 200 and the first electrical contact 300 for the counter-connection device 100' is obtained.

Three alternative third steps III of the assembly of the coaxial cable 60 with the connection device 100 and the counter-connection device 100' are shown in FIGS. 8-10, 11-13, and 14-17. In the third step III, a second electrical contact 400 is mounted. The second electrical contact 400 has a different configuration depending on whether it is mounted on the first sub assembly 20 for the connection device 100 or the sub-assembly 20' for the counter-connection device 100', however, the three alternative third steps III are substantially the same.

Figure 10:
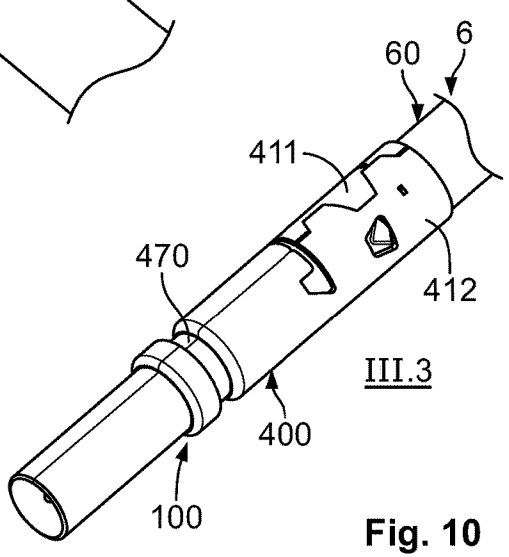
FIG. 10 is a perspective view of the cable, the ferrule, the first electrical contact, and the second electrical contact of the connection device in a third partial step of the first alternative third step of the assembly of the cable with the connection device or the counter-connection device.
Figure 13:
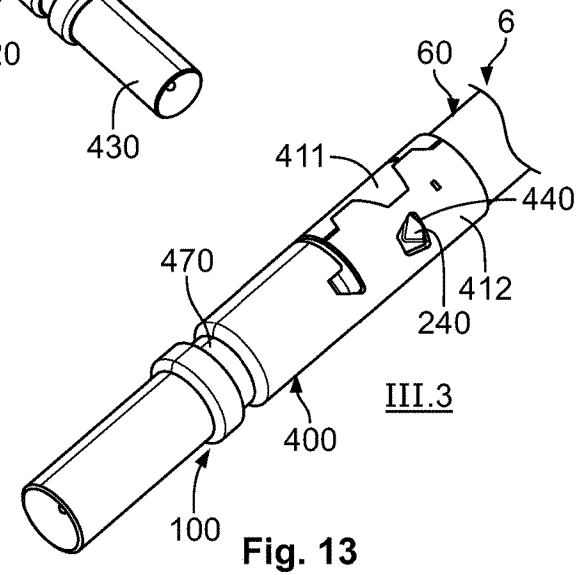
FIG. 13 is a perspective view of the cable, the ferrule, the first electrical contact, and the second electrical contact of the connection device in a third partial step of the second alternative third step of the assembly of the cable with the connection device or the counter-connection device.
Figure 17:
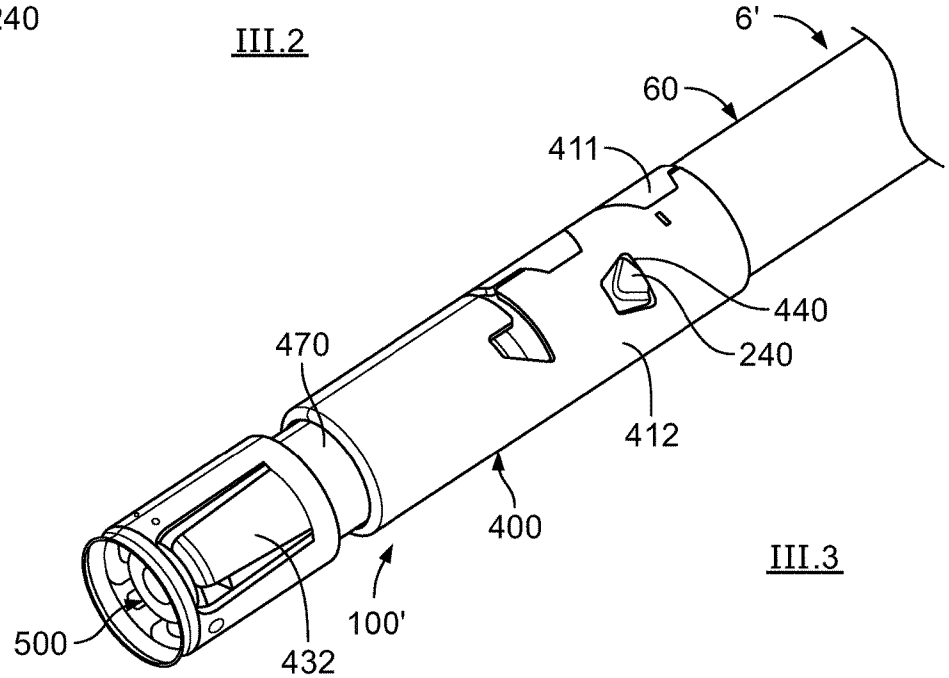
FIG. 17 is a perspective view of the cable, the ferrule, the first electrical contact, and the second electrical contact of the counter-connection device in a third partial step of the third alternative third step of the assembly of the cable with the connection device or the counter-connection device.

The elongated and integrally formed second electrical contact 400 has on a rear end a crimping section 410, with two crimping wings 411, 412. Each crimping wing 411, 412 has a circumferential edge section 413, 414. The two circumferential edge sections 413, 414 are substantially complementary and substantially form-locked to one another so that a gap between the crimping wings 411, 412 of the mounted second electrical contact 400 in the axial direction Ax of the second electrical contact 400, shown in FIGS. 10, 13, and 17, is substantially impermeable to light. The second electrical contact 400 has a shielding contact section 430 on an opposite front end. The second electrical contact 400 also has a transitional section 420 between the crimping section 410 and the contact section 430 which is in the form of a sleeve. A locking recess 440 of the second electrical contact 400 is disposed on at least one crimping wing 411, 412.

A dielectric 500, as shown in FIGS. 1 and 14-17, is disposed within the second electrical contact 400. The dielectric 500 insulates the first electrical contact 300 from the second electrical contact 400 and, furthermore, is used to center the first electrical contact 300 in the second electrical contact 400. The dielectric 500 may be locked in the second electrical contact 400, or at least in a direction S of plugging the dielectric 500 into the second electrical contact 400.

Figure 8:
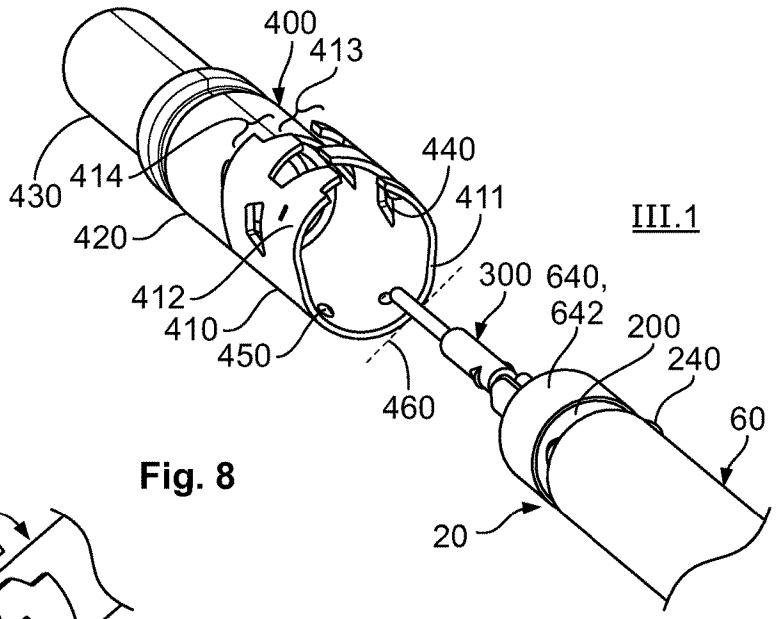
FIG. 8 is a perspective view of the cable, the ferrule, the first electrical contact, and a second electrical contact of the connection device in a first partial step of a first alternative third step of the assembly of the cable with the connection device or the counter-connection device.
Figure 9:
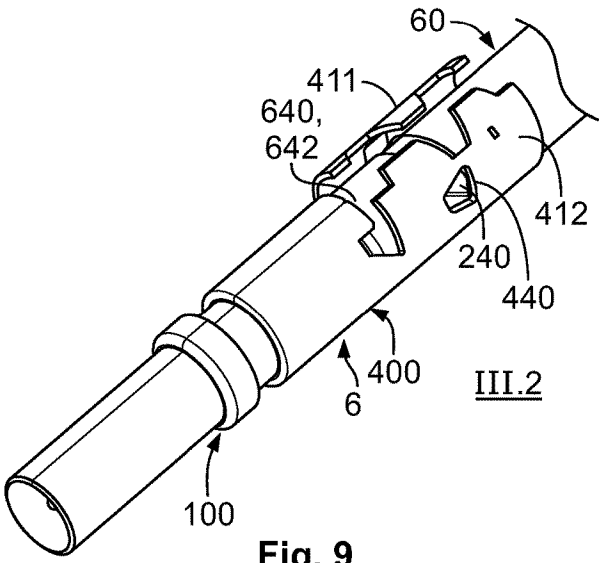
FIG. 9 is a perspective view of the cable, the ferrule, the first electrical contact, and the second electrical contact of the connection device in a second partial step of the first alternative third step of the assembly of the cable with the connection device or the counter-connection device.

In the first alternative third step III shown in FIGS. 8-10, in a first partial step III.1 shown in FIG. 8, the sub-assembly 20 is inserted into the second electrical contact 400 with bent or pre-rolled crimping wings 411, 412. The second electrical contact 400 remains on a carrier strip 460 during insertion and is removed from the carrier strip in the second partial step III.2 shown in FIG. 9. In a subsequent third partial step III.3 shown in FIG. 10, the crimping section 410 is crimped and the ferrule 200 locks with the crimping section 410, producing the assembled cable 6 and connection device 100. In the connection device 100, the crimping section 410 locks the second electrical contact 400 both on the cable 60 and on the ferrule 200 or on the turned over end section 642 of the outer conductor 640. The locking projection 240 of the ferrule 200 engages with the locking recess 440 of the second electrical contact 400.

FIGS. 8-10 illustrate the connection device 100 with the sub-assembly 20 having a pin first electrical contact 300; it is of course also possible to use the first electrical sub-assembly 20' having the jack first electrical contact 300. When the first electrical sub-assembly 20' is mounted with the second electrical contact 400, the second electrical contact 400 has at least one shielding contact spring 432 in the contact section 430 that has been cut free or punched out as shown in FIGS. 14-17.

Figure 11:
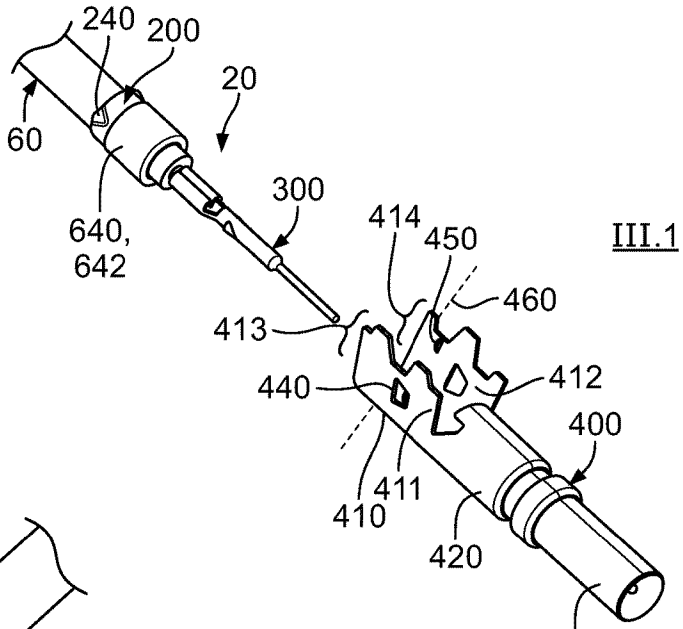
FIG. 11 is a perspective view of the cable, the ferrule, the first electrical contact, and the second electrical contact of the connection device in a first partial step of a second alternative third step of the assembly of the cable with the connection device or the counter-connection device.
Figure 12:
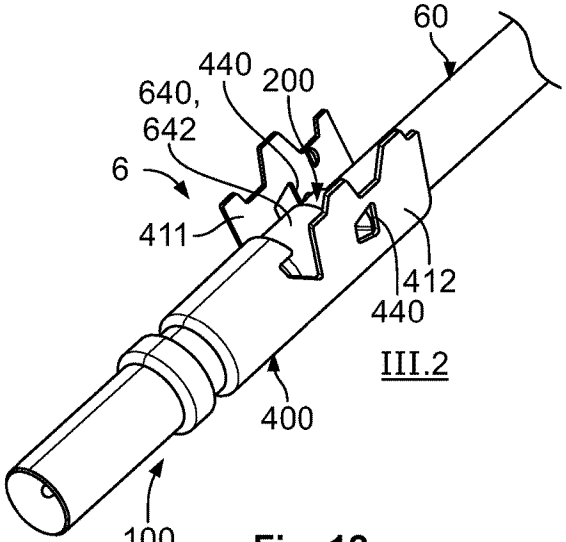
FIG. 12 is a perspective view of the cable, the ferrule, the first electrical contact, and the second electrical contact of the connection device in a second partial step of the second alternative third step of the assembly of the cable with the connection device or the counter-connection device.

In the second alternative third step III shown in FIGS. 11-13, in a first partial step III.1 shown in FIG. 11, the sub-assembly 20 is inserted into the second electrical contact 400 with substantially straight crimping wings 411, 412. The second electrical contact 400 remains on a carrier strip 460 during insertion and is removed from the carrier strip in the second partial step III.2 shown in FIG. 12. In a subsequent third partial step III.3 shown in FIG. 13, the crimping section 410 is crimped and the ferrule 200 locks with the crimping section 410, producing the assembled cable 6 and connection device 100. In the connection device 100, the crimping section 410 locks the second electrical contact 400 both on the cable 60 and on the ferrule 200 or on the turned over end section 642 of the outer conductor 640. The locking projection 240 of the ferrule 200 engages with the locking recess 440 of the second electrical contact 400.

FIGS. 11-13 illustrate the connection device 100 with the sub-assembly 20 having a pin first electrical contact 300; it is of course also possible to use the first electrical sub-assembly 20' having the jack first electrical contact 300. When the first electrical sub-assembly 20' is mounted with the second electrical contact 400, the second electrical contact 400 has at least one shielding contact spring 432 in the contact section 430 that has been cut free or punched out as shown in FIGS. 14-17.

Figure 14:
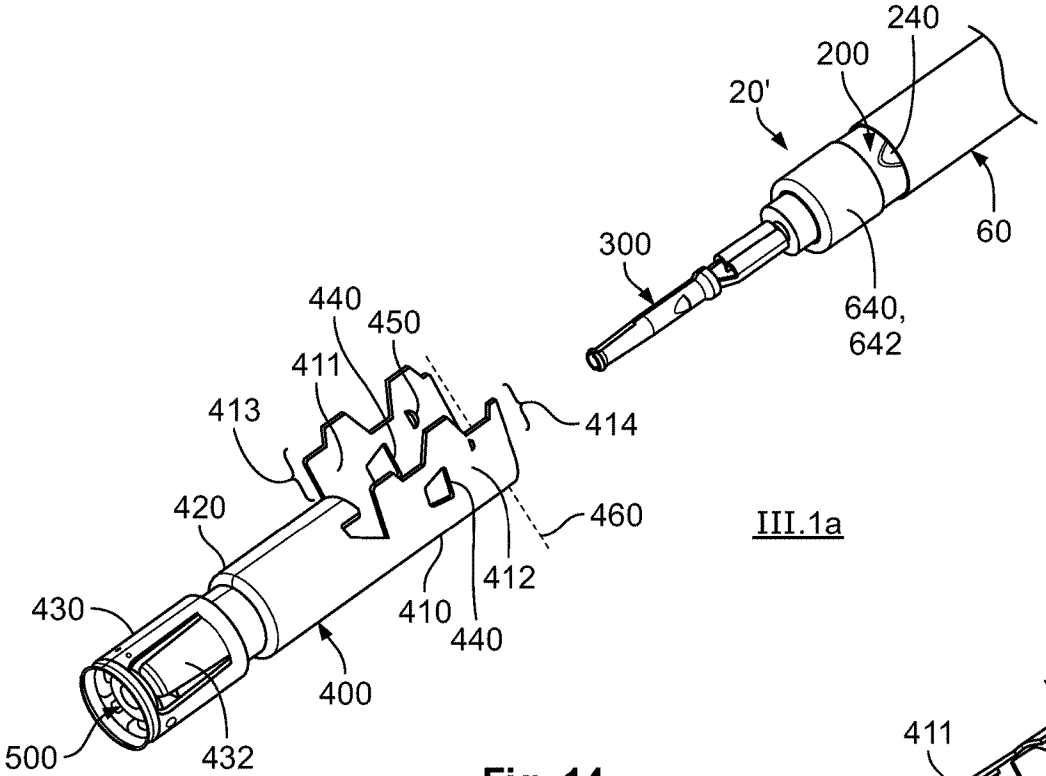
FIG. 14 is a perspective view of the cable, the ferrule, the first electrical contact, and a second electrical contact of the counter-connection device in a preparatory step of a third alternative third step of the assembly of the cable with the connection device or the counter-connection device.
Figure 15:
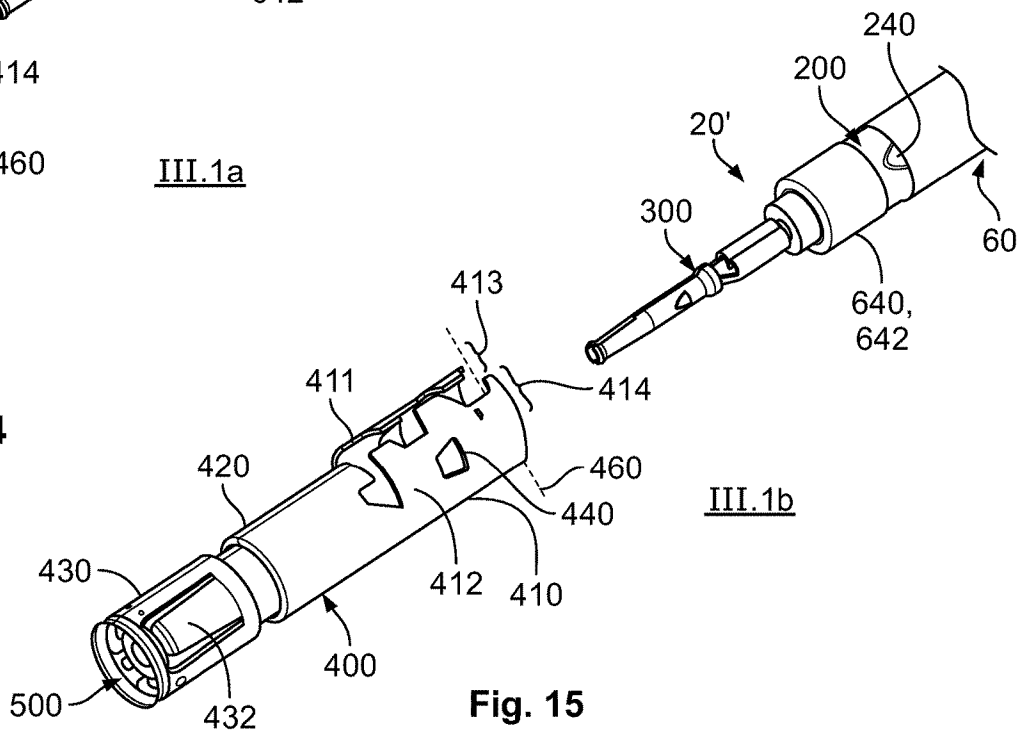
FIG. 15 is a perspective view of the cable, the ferrule, the first electrical contact, and the second electrical contact of the counter-connection device in a first partial step of the third alternative third step of the assembly of the cable with the connection device or the counter-connection device.
Figure 16:
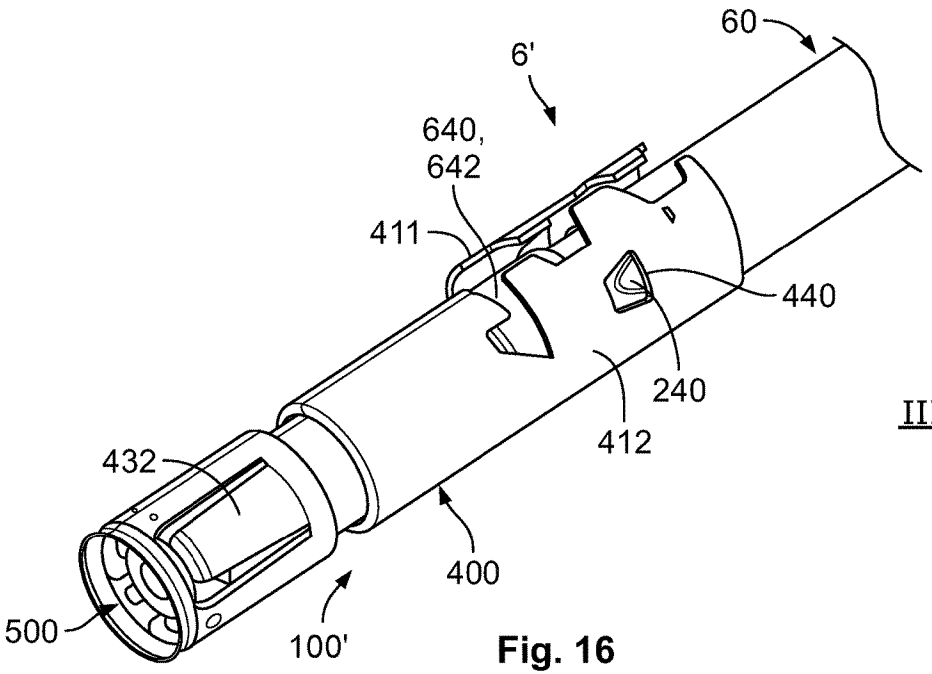
FIG. 16 is a perspective view of the cable, the ferrule, the first electrical contact, and the second electrical contact of the counter-connection device in a second partial step of the third alternative third step of the assembly of the cable with the connection device or the counter-connection device.

In the third alternative third step III shown in FIGS. 14-17, in a preparatory step III.1*a* which can be part of a first partial step III.1*b*, a second electrical contact 400 with substantially straight crimping wings 411, 412 as shown in FIG. 14 is pre-bent or pre-rolled into the state shown in FIG. 15. The second electrical contact 400 remains on the carrier strip 460 during the preparatory step III.1*a*. The sub-assembly 20 is then inserted into the second electrical contact 400 with bent or pre-rolled crimping wings 411, 412, and the second electrical contact 400 remains on a carrier strip 460 during insertion and is removed from the carrier strip in the second partial step III.2 shown in FIG. 16. In a subsequent third partial step III.3 shown in FIG. 17, the crimping section 410 is crimped and the ferrule 200 locks with the crimping section 410, producing the assembled cable 6' and the counter-connection device 100'. In the counter-connection device 100', the crimping section 410 locks the second electrical contact 400 both on the cable 60 and on the ferrule 200 or on the turned over end section 642 of the outer conductor 640. The locking projection 240 of the ferrule 200 engages with the locking recess 440 of the second electrical contact 400.

FIGS. 14-17 illustrate the counter-connection device 100' with the sub-assembly 20' having a jack first electrical contact 300; the second electrical contact 400 has the at least one shielding contact spring 432 described above. It is of course also possible to use the first electrical sub-assembly 20 having the pin first electrical contact 300 as described above in FIGS. 8-13.

In the connection device 100 and the counter-connection device 100' produced as described in FIGS. 8-17, the contact section 430 extends from a mating face of the second electrical contact 400 to the rear in the axial direction Ax at least so far such that in a plugged state of a connection device 100 to a counter-connection device 100', sections of the respective contact sections 330, 330 of respective first electrical contacts 300, 300 that are plugged into one another are fully shielded electromagnetically as shown in FIG. 1.

The connection device 100 and counter-connection device 100' are shown in greater detail in FIGS. 18-22.

Figure 21:
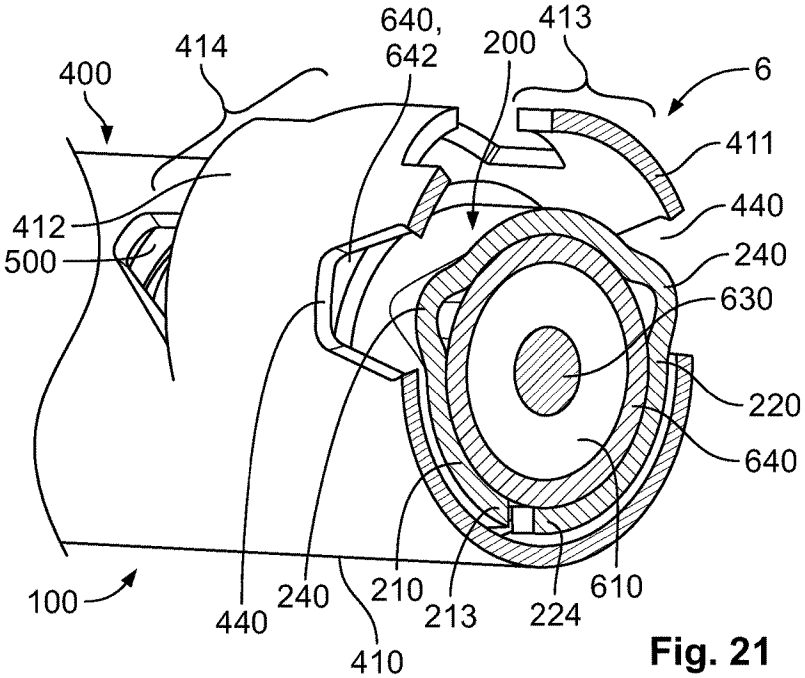
FIG. 21 is a perspective sectional view of the connection device of FIG. 18 or the counter-connection device of FIG. 19.
Figure 22:
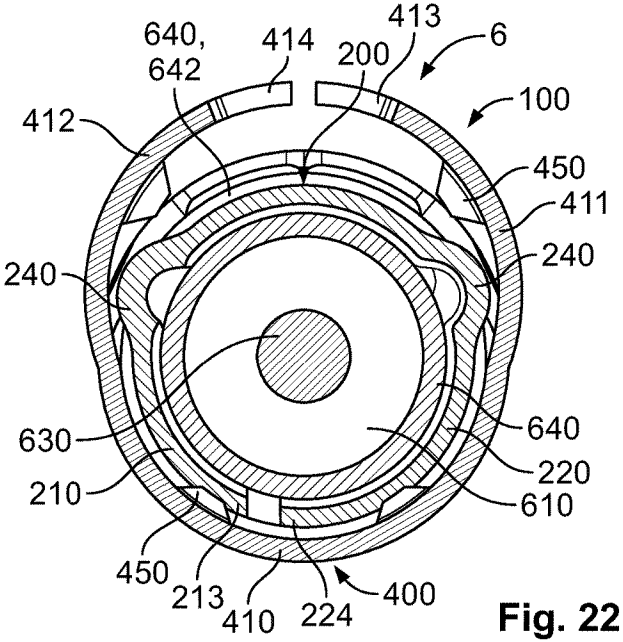
FIG. 22 is a front sectional view of the connection device of FIG. 18 or the counter-connection device of FIG. 19.

In FIGS. 21 and 22, two locking projections 240 are formed by a material layer of the ferrule 200. A space between the two crimping flanks 210, 220 at the circumferential edges 213, 224 is also shown.

The second electrical contact 400, as shown in FIG. 22, has an inner projection 450 disposed on an inside surface of the crimping section 410. The inner projection 450, as shown in FIG. 22, locks the second electrical contact 400 on the cable 60 and fixes the turned over end section 642 of the outer conductor 640 on the ferrule 200 and the ferrule 200 on the outer conductor 640. Depending on the mounting method and also the consistency of the outer insulation 620, a recess or passage recess can also be used as a blocking means 450 in the mounting section 410. In the shown embodiment, the second electrical contact 400 has four inner projections 450, two inner projections on the transitional section 420 and two inner projections 450 on the crimping wings 411, 412. One with ordinary skill in the art would understand that other quantities of inner projections 450 could be used.

Figure 23:
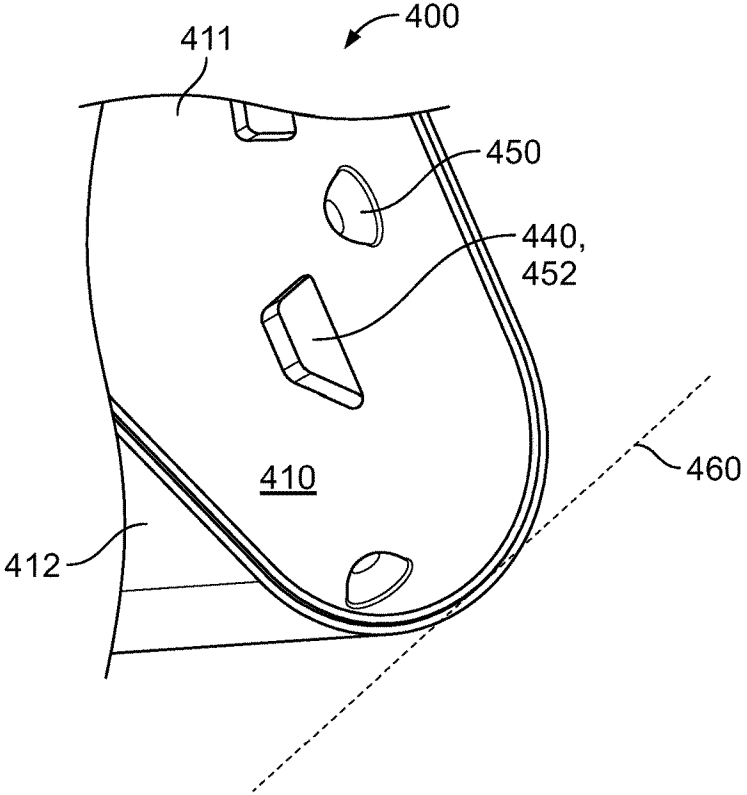
FIG. 23 is a perspective view of a second electrical contact according to an embodiment of the invention.

In another embodiment, shown in FIG. 23, the second electrical contact 400 has a plurality of recesses 452 at the crimping section 410. The recess 452 may function as the locking recess 440.

Figure 24:
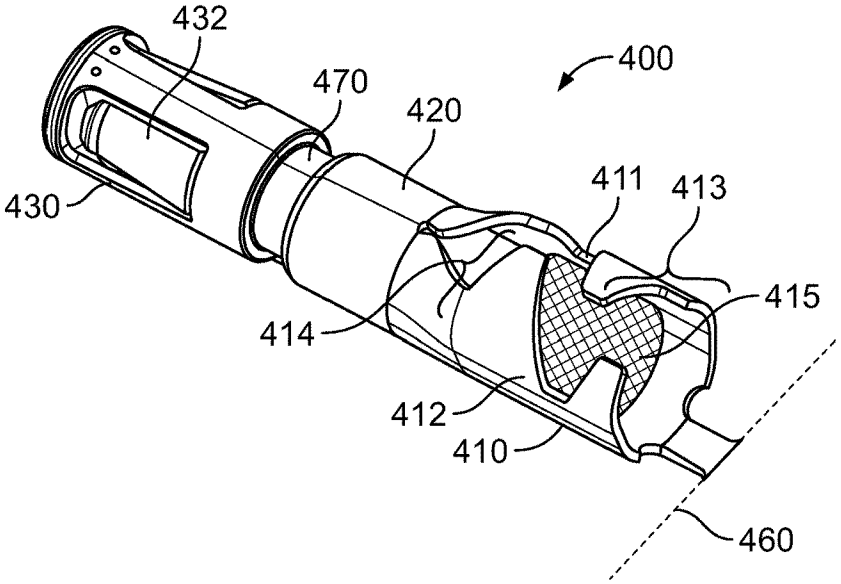
FIG. 24 is a perspective view of another second electrical contact according to an embodiment of the invention.

In another embodiment, shown in FIG. 24, the second electrical contact 400 has a corrugation 415 at the crimping section 410. The corrugation 415 retains the cable 60 in the second electrical contact 400.

Figure 18:
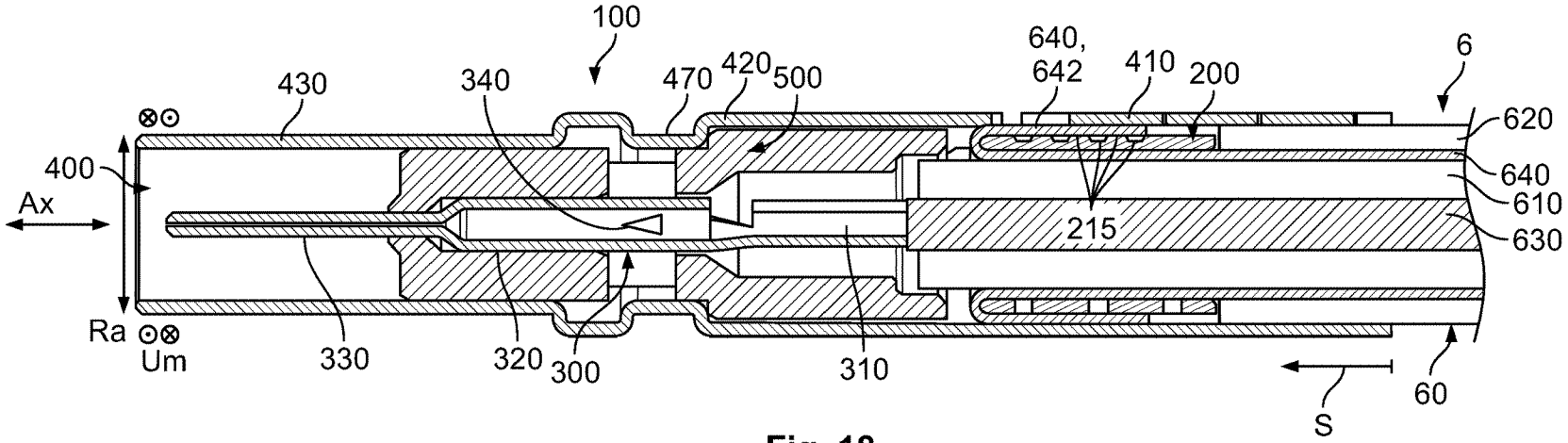
FIG. 18 is a sectional view of the connection device.
Figure 19:
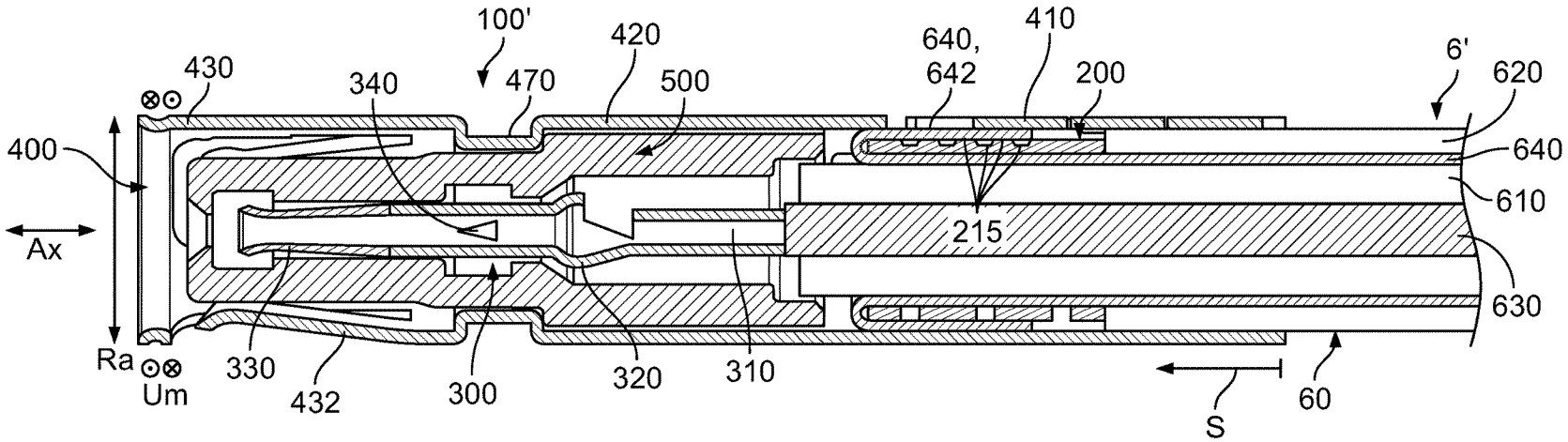
FIG. 19 is a sectional view of the counter-connection device.
Figure 20:
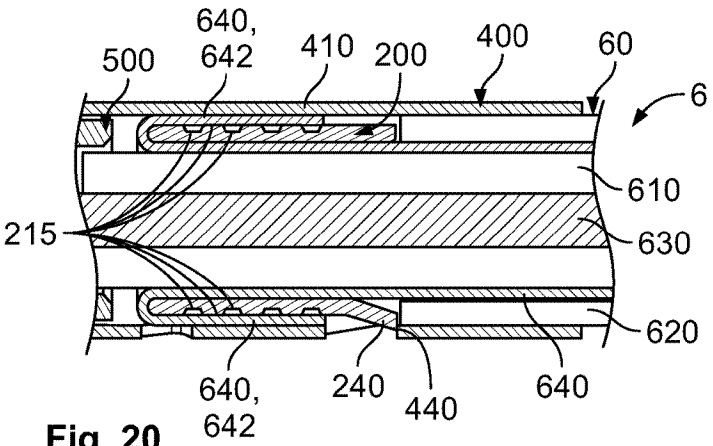
FIG. 20 is an enlarged side sectional view of the connection device of FIG. 18 or the counter-connection device of FIG. 19.

The ferrule 200, as shown in FIGS. 18-20, has a plurality of grooves 215 integrated at an inner side or an outer side of the ferrule 200. If the grooves 215 are integrated at the inner side of the ferrule 200, the grooves 215 engaging with an inner end section of the outer conductor 640 when the ferrule 200 is mounted at the cable 60. If the grooves 215 are integrated at the outer side of the ferrule 200, the grooves 215 interact with the turned over end section 642 of the outer conductor 640 when the second electrical contact 400 is mounted above the ferrule 200. The corrugation 415 of the second electrical contact 400 engages the cable 60 during mounting of the second electrical contact 400 at the cable 60. This results in a secure hold of the second electrical contact 400 at the turned over end section 642 of the outer conductor 640.

Figure 25:
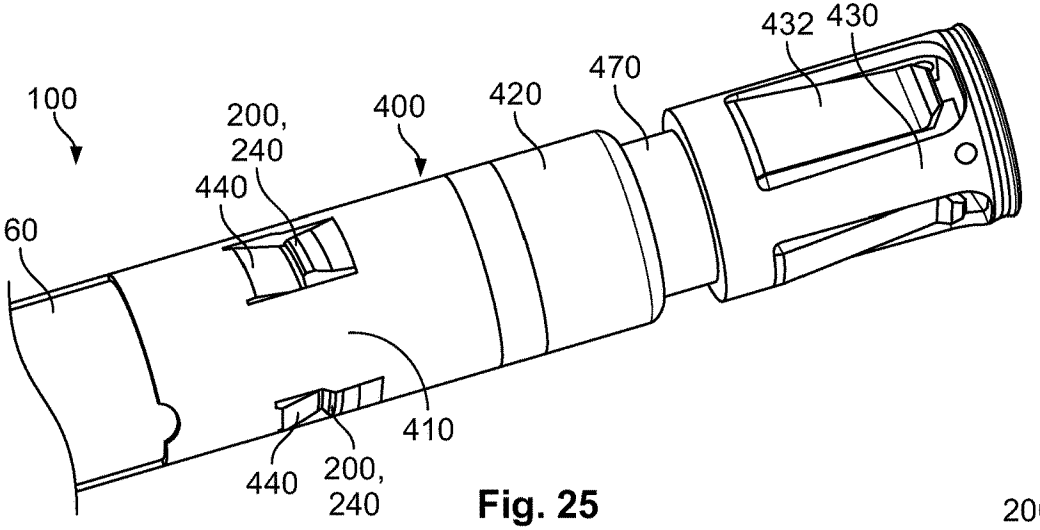
FIG. 25 is a perspective view of a connection device according to another embodiment of the invention.
Figure 26:
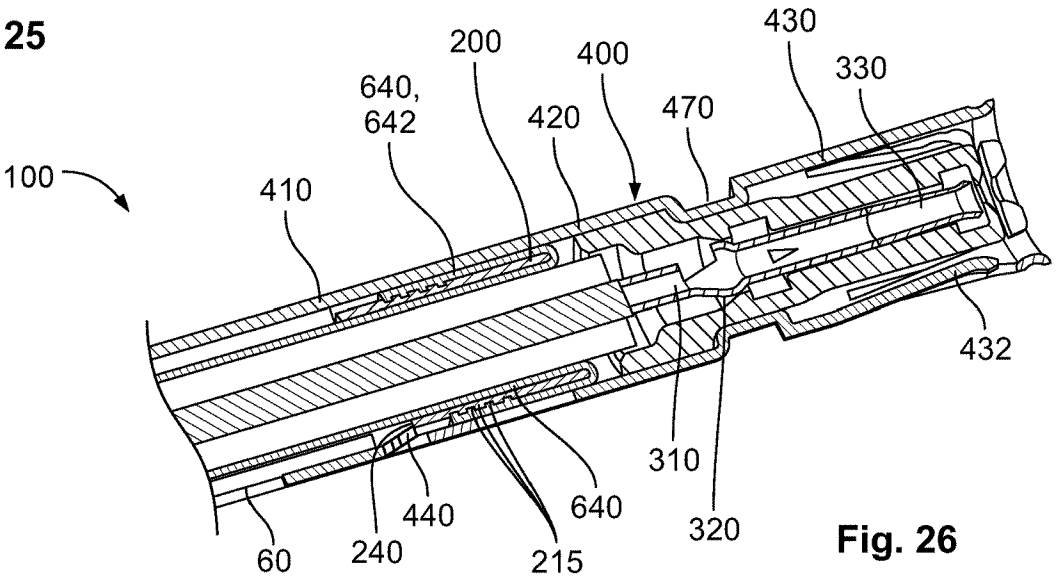
FIG. 26 is a sectional view of the connection device of FIG. 25.

In another embodiment shown in FIGS. 25 and 26, the locking of the ferrule 200 with the second electrical contact 400 is inverted. Here, the second electrical contact 400 has a plurality of locking projections 440 cut free from or punched out from the crimping section 410. The locking projections 440 protrude into an inner side of the second electrical contact 400. During crimping of the second electrical contact 400 on the cable 60, the locking projections 440 block the locking projections 240 of the ferrule 200, locking the ferrule 200 with the second electrical contact 400 in the axial direction Ax. In addition to a frictional engagement by crimping between the ferrule 200, the turned over end section 642 of the outer conductor 640, and the second electrical contact 400, or between the ferrule 200 and the second electrical contact 400, an extra mechanical locking feature between the ferrule 200 and the second electrical contact 400 is established. This extra locking feature is established by locking, blocking or retaining the ferrule 200 and the second electrical contact 400 in the axial direction Ax, in a counter-plugging direction of the connection device 100. The locking between the ferrule 200 and the second electrical contact 400 serves as strain relief at cable pull.

A connector 1 according to the invention, as shown in FIGS. 27-32, has a connector housing 10 and the connection device 100. A counter-connector 1' has a connector housing 10' and the counter-connection device 100'.

Figure 27:
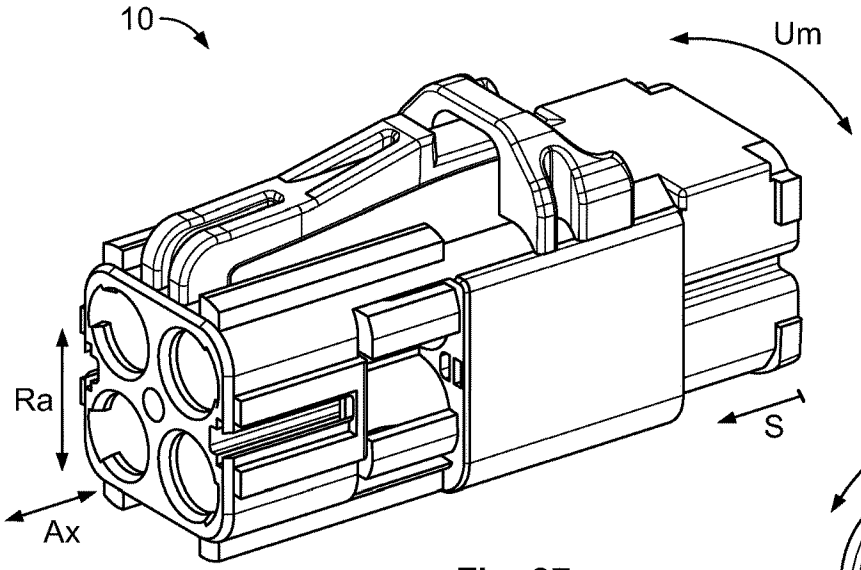
FIG. 27 is a perspective view of a plug connector housing.
Figure 28:
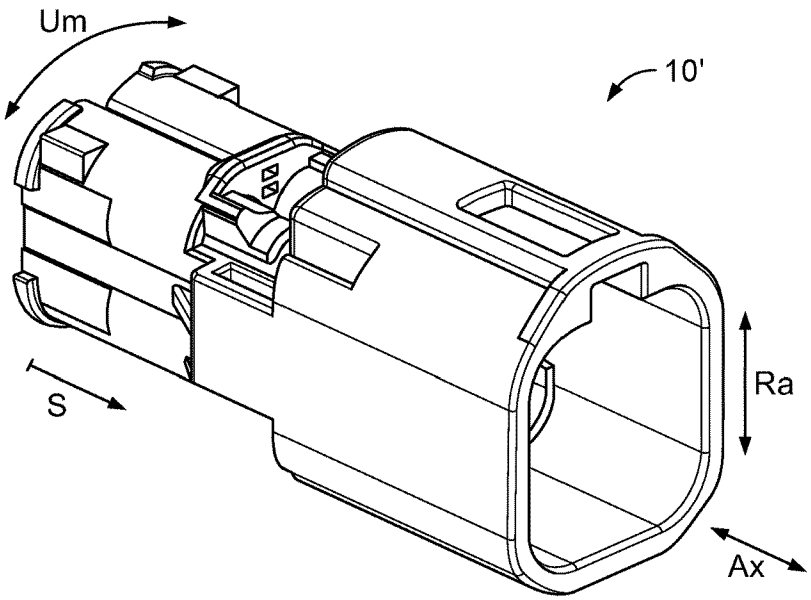
FIG. 28 is a perspective view of a receptacle connector housing.
Figure 29:
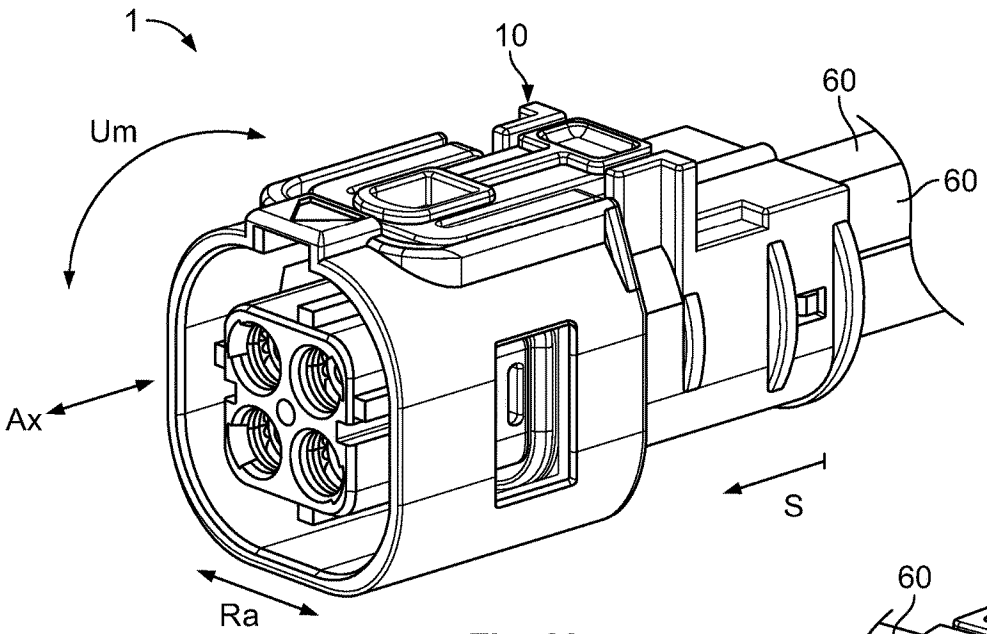
FIG. 29 is a perspective view of another plug connector housing.
Figure 30:
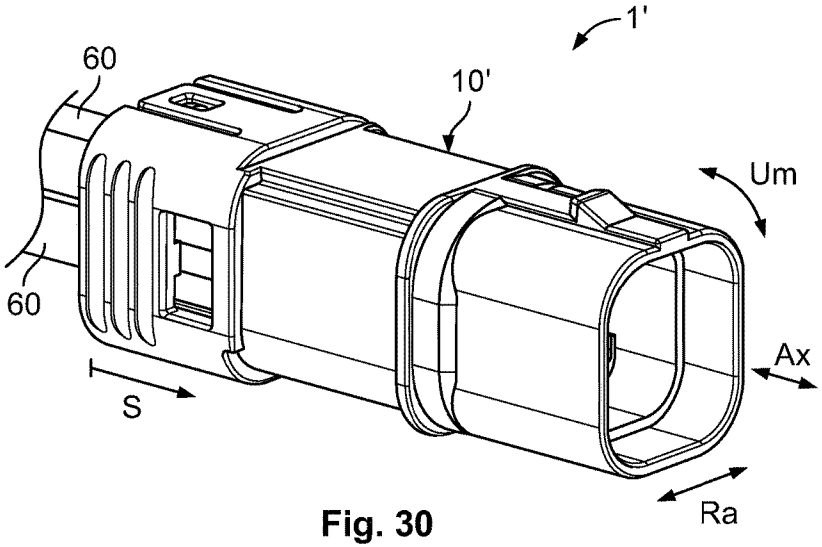
FIG. 30 is a perspective view of another receptacle connector housing.

In an embodiment shown in FIGS. 27 and 28, a plug connector housing 10 shown in FIG. 27 is matable with a receptacle connector housing 10' shown in FIG. 28. In another embodiment shown in FIGS. 29 and 30, a plug connector housing 10 shown in FIG. 29 is matable with a receptacle connector housing 10' shown in FIG. 30.

Figure 31:
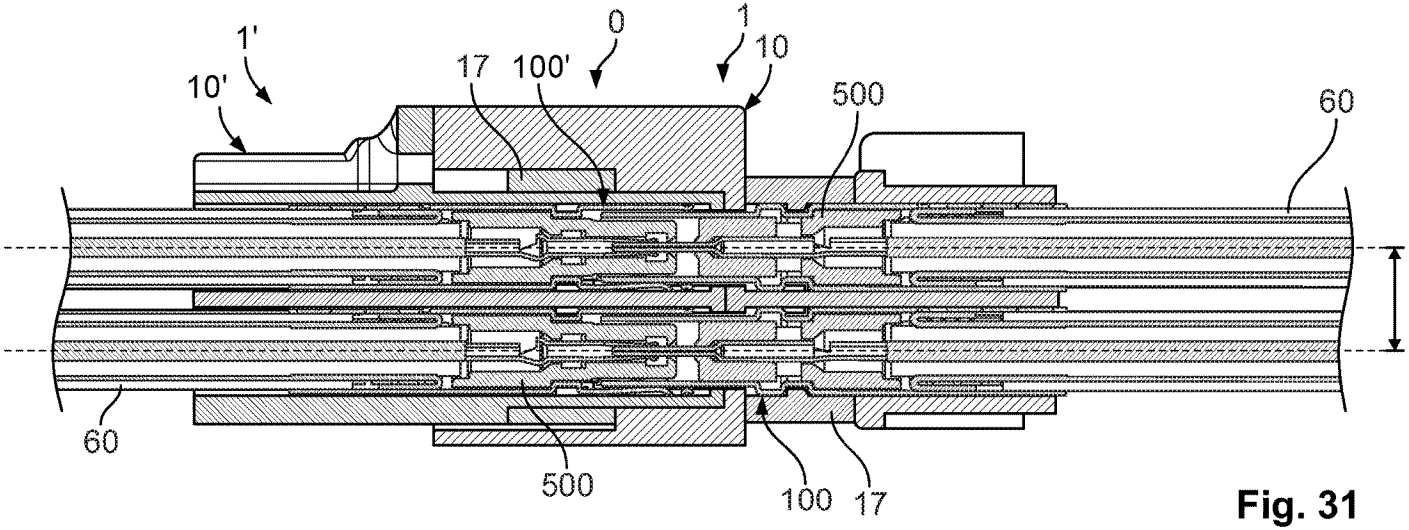
FIG. 31 is a sectional view of a connector and a counter-connector according to the invention in a connected state.
Figure 32:
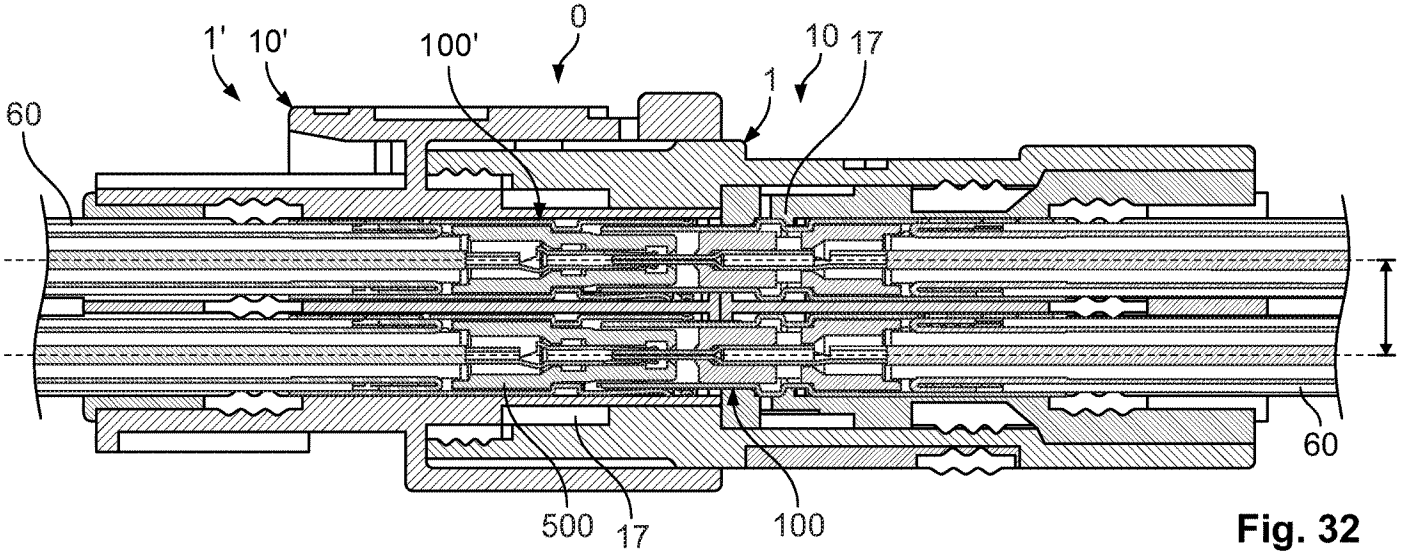
FIG. 32 is a sectional view of another connector and another counter-connector according to the invention in a connected state.

The connection device 100, 100' is fixed in the connector housing 10 10' by a retainer 17 extending through the connection housing 10, 10' as shown in FIGS. 31 and 32. The retainer 17 comprises a locking means, such as a recess or projection, by which the second electrical contact 400 or, respectively, the entire connection device 100, and thus the cable 60, can be fixed in the connector housing 10 in at least one translational direction opposite to a plugging direction of the connection device 100. The second electrical contact 400 correspondingly has a circumferential locking device 470, such as a projection or a recess shown in FIGS. 18 and 19, engaging the retainer 17. The connection device 100 may also have a resilient locking strap engaging a correspondingly formed locking device in the connector housing 10. This type of locking strap can be cut free from or be punched out of the connection device 100 or, respectively, the second electrical contact 400 and be bent open. FIGS. 31 and 32 show the connector 1 and the counter-connector 1' in a plugged and connected state 0.

What is claimed is:

1. An electrical connection device, comprising:

a cable having an outer conductor surrounding an inner conductor;

a ferrule having a pair of opposing crimping flanks with each crimping flank having along its length circumferential edge sections form-locking so that a gap between the crimping flanks in an axial direction is substantially impermeable to light, and mechanically connected to the outer conductor, an end section of the outer conductor abutting both an inner surface and an opposite outer surface of the ferrule; and a first electrical contact electrically connected to the inner conductor.

2. The electrical connection device of claim 1, wherein the cable is a copper or aluminum cable.

3. The electrical connection device of claim 1, wherein an entire length of the ferrule in a longitudinal direction of the ferrule is connected to the outer conductor, and the ferrule has a substantially constant internal diameter in the longitudinal direction of the ferrule.

4. The electrical connection device of claim 1, wherein the ferrule is integrally formed in a single material layer and has a U-shaped cross-section.

5. The electrical connection device of claim 1, further comprising a second electrical contact electrically connected to the outer conductor.

6. The electrical connection device of claim 5, wherein the second electrical contact and the outer conductor are disposed above the ferrule.

7. The electrical connection device of claim 6, wherein the second electrical contact is locked to the ferrule, preventing movement of the ferrule in a longitudinal direction of the ferrule.

8. The electrical connection device of claim 7, wherein a locking projection of the ferrule engages with a locking recess of the second electrical contact.

9. The electrical connection device of claim 7, wherein the ferrule has a plurality of grooves engaging the end section of the outer conductor.

10. The electrical connection device of claim 7, wherein the second electrical contact has a corrugation engaging the cable.

11. The electrical connection device of claim 7, wherein the second electrical contact has a pre-rolled crimping wing.

12. The electrical connection device of claim 11, wherein the crimping wing is crimped over the outer conductor at the ferrule.

13. The electrical connection device of claim 1, wherein the end section of the outer conductor has a circumferential U-shape and extends around an end of the ferrule.

14. A connector, comprising:

a connector housing; and a connection device disposed in the connector housing, the connection device including a cable having an outer conductor surrounding an inner conductor, a ferrule having a pair of opposing crimping flanks with each crimping flank having along its length circumferential edge sections form-locking so that a gap between the crimping flanks in an axial direction is substantially impermeable to light, and mechanically connected to the outer conductor, an end section of the outer conductor abutting both an inner surface and an opposite outer surface of the ferrule, and a first electrical contact electrically connected to the inner conductor.

15. A method of assembling a connection device, comprising:

providing a coaxial cable having an outer conductor surrounding an inner conductor;

fixing a ferrule to the outer conductor and forming a gap between crimping flanks in an axial direction that is substantially impermeable to light, an end section of the outer conductor abutting both an inner surface and an opposite outer surface of the ferrule; and connecting a first electrical contact to the inner conductor after the fixing step.

16. The method of claim 15, further comprising attaching a second electrical contact above the ferrule after the connecting step.

17. The method of claim 16, wherein the second electrical contact is electrically connected to the outer conductor and fixed to the cable.

18. The method of claim 16, wherein, in the attaching step, a crimping wing of the second electrical contact is pre-bent or pre-rolled, a sub-assembly including the cable, the ferrule, and the first electrical contact is inserted into the second electrical contact, and the second electrical contact is crimped to the cable.

19. The method of claim 18, wherein the second electrical contact is on a carrier strip and is separated from the carrier strip prior to crimping the second electrical contact to the cable.

20. The method of claim 15, wherein, in the fixing step, the cable is inserted into the ferrule with a section of an outer insulation of the cable removed, the ferrule is crimped to the outer conductor, the exposed end section of the outer conductor is bent around an outside of the ferrule, and an inner insulation of the cable is removed from an exposed end section of the cable.

* * * * *